US009554654B1

(12) United States Patent
Jung

(10) Patent No.: US 9,554,654 B1
(45) Date of Patent: Jan. 31, 2017

(54) FOLDING CHAIR HAVING FRICTION DAMPING PART

(71) Applicant: SHINYANG C&S CO., LTD., Damyang-gun (KR)

(72) Inventor: Tae Young Jung, Gwangju (KR)

(73) Assignee: SHINYANG C&S CO., LTD., Damyanggun (KR)

( * ) Notice: Subject to any disclaimer, the term of this patent is extended or adjusted under 35 U.S.C. 154(b) by 0 days.

(21) Appl. No.: 14/881,246

(22) Filed: Oct. 13, 2015

(30) Foreign Application Priority Data

Sep. 24, 2015 (KR) ..... 10-2015-0135759

(51) Int. Cl.

| | |
|---|---|
| ***A47C 1/12*** | (2006.01) |
| ***A47C 1/121*** | (2006.01) |
| ***A47C 7/58*** | (2006.01) |
| ***A47C 3/18*** | (2006.01) |

(52) U.S. Cl.
CPC .. *A47C 7/58* (2013.01); *A47C 3/18* (2013.01)

(58) Field of Classification Search
CPC ..... A47C 1/121; A47C 1/56; A47C 1/60; A47C 7/56; A47C 7/60
USPC ..... 297/332, 463.1, 463.2
See application file for complete search history.

(56) References Cited

U.S. PATENT DOCUMENTS

| | | | | |
|---|---|---|---|---|
| 2,000,172 | A * | 5/1935 | Hanson | A47C 7/58 297/249 |
| 5,257,852 | A * | 11/1993 | Tsuneki | A47C 1/121 297/332 X |
| 5,899,531 | A * | 5/1999 | Koehler | A47C 1/121 297/332 X |
| 7,000,989 | B2 * | 2/2006 | Fisher | A47C 1/16 297/332 |
| 2008/0217979 | A1 * | 9/2008 | King | A47C 1/121 297/338 |
| 2009/0315377 | A1 * | 12/2009 | Figueras Mitjans | A47C 7/58 297/332 |
| 2010/0213745 | A1 * | 8/2010 | Figueras Mitjans | A47C 7/563 297/340 |
| 2011/0024246 | A1 * | 2/2011 | Mitjans | A47C 1/121 188/297 |

* cited by examiner

*Primary Examiner* — Rodney B White
(74) *Attorney, Agent, or Firm* — Lex IP Meister, PLLC

(57) ABSTRACT

A folding chair having a friction damping part for decelerating a rotary speed of a seat board is provided. The folding chair comprises the seat board vertically rotatably supported between a pair of stand frames, a rotary connection part connecting the seat board to the pair of stand frames to be vertically rotatable while having a rotary shaft line as a center of rotation, and a damping part capable of decelerating a rotary speed of the seat board. The damping part comprises a friction clutch disposed on the rotary shaft line and having a friction surface arranged in a direction perpendicular to the rotary shaft line, a clutch pressure plate integrally rotating with the seat board and having a pressure surface configured to come in contact with the friction surface of the friction clutch, and an elastic pressure body elastically pressing the clutch pressure plate toward the friction clutch.

12 Claims, 7 Drawing Sheets

FOLDING CHAIR HAVING FRICTION DAMPING PART

CROSS-REFERENCE TO RELATED APPLICATION

This application claims priority to and the benefit of Korean Patent Application No. 10-2015-0135759, filed on Sep. 24, 2015, the disclosure of which is incorporated herein by reference in its entirety.

BACKGROUND

1. Field of the Invention

The present invention relates to a folding chair having a friction damping part, and more particularly, to a folding chair having a friction damping part in which a damping part for decelerating a rotary speed of a seat board is disposed at a folding chair, such as a grandstand, having the seat board vertically rotatably supported between a pair of stand frames to reduce noise generation and decrease a possibility of being damaged due to rapid rotation of the seat board and decrease a possibility of accidents caused by the rapidly rotating seat board, while a friction force and elastic force are used in damping to have a simple structure by a mechanical mechanism, be easily manufactured, and guarantee a sufficient damping force.

2. Discussion of Related Art

Generally, a chair for viewing, i.e. a grandstand seat, is installed at a multiuse facility such as various types of stadiums, movie theaters, etc. For efficient space utilization in installing the grandstand seat, a stepped concrete structure is installed, and the grandstand seat is installed on an inclined surface, a wall, or a horizontal surface (floor surface) of the concrete structure.

As disclosed in Korean utility model gazette No. 20-1993-0003026, a foldable chair in which a seat member is folded toward a backrest member is mostly used as the grandstand seat to provide a moving space to enable people to easily pass by.

In a conventional grandstand seat, a fixing bracket was fixed and installed at one side of a seat member using a screw, a fixing shaft formed as above was inserted into a frame, a fixing bracket was inserted into another side of the frame, and a seat board was put on a seat board fastening part of the fixing bracket and fixed and assembled to the bracket by a screw.

The grandstand seat has a torsion spring installed at a rotary shaft of the seat member to enable the seat member to automatically rotate by an elastic force of the torsion spring.

In other words, when a person uses the grandstand seat, the person sits thereon after the seat member rotates in a direction away from the backrest member. When the person stands up, the seat member rotates in a direction toward the backrest member to be folded by an elastic force of the torsion spring.

However, the grandstand seat had a disadvantage of generating noise which disturbs viewing of others as the seat member collides with the backrest member when rotating by the elastic force of the torsion spring, or causing the seat member and the backrest member to be damaged due to an impact caused by the collision, and had a problem of causing accidents by the rapid rotation of the seat member at a chaotic situation caused by many people pouring into a stadium.

To overcome the above disadvantage of the grandstand seat, "Damper for Rotary Chair" has been suggested in Korean Unexamined Patent Application Publication No. 10-2015-0072557.

However, the damper for a rotary chair decelerates a rotary speed of a seating member by filling a filling liquid such as silicone oil having predetermined viscosity into an installation space in which a torsion spring for rotating the seat member by an elastic force is embedded to provide a friction force to the torsion spring, thereby having a possibility of leakage of the filling liquid and thus having a limitation in maintaining a sufficient damping force for a long period, and having a disadvantage of not being able to be installed at a circular grandstand since the seat member cannot be installed at a slant with respect to a frame.

SUMMARY OF THE INVENTION

The present invention has been devised to solve the above problems of the prior art, and an aspect of the present invention is to provide a folding chair having a friction damping part in which a damping part which decelerates a rotary speed of a seat board is disposed at a folding chair to reduce noise generation and decrease a possibility of being damaged due to a rapid rotation of a seat board and decrease a possibility of accidents caused by the rapidly rotating seat board.

Another aspect of the present invention is to provide a folding chair having a friction damping part which uses a friction force and elastic force in damping to have a simple structure by a mechanical mechanism, be easily manufactured, not malfunction frequently, and guarantee a sufficient damping force.

Still another aspect of the present invention is to provide a folding chair having a friction damping part which maintains a rotary structure and is able to install a seat board at a slant in a front and rear direction, thereby being able to be installed at a circular grandstand.

To achieve the above aspects, a folding chair having a friction damping part according to the present invention may include a pair of stand frames stood upright on a floor; a seat board disposed between the pair of stand frames in a shape on which a user may be seated; a rotary connection part for connecting the seat board to the pair of stand frames to be vertically rotatable while having a rotary shaft line as a center of rotation; and a damping part capable of decelerating a rotary speed of the seat board, wherein the damping part may include a friction clutch disposed on the rotary shaft line and having a friction surface arranged in a direction perpendicular to the rotary shaft line, a clutch pressure plate integrally rotating with the seat board and having a pressure surface coming in contact with the friction surface of the friction clutch, and an elastic pressure body elastically pressing the clutch pressure plate toward the friction clutch.

In addition, in the folding chair having a friction damping part according to the present invention, the rotary connection part may include fixed housings respectively fixed to the pair of stand frames, and a rotary bracket connected to the fixed housings while being fixed to the seat board, wherein the fixed housings have shaft fixing grooves formed at central portions, and the rotary bracket includes a connection shaft having a front end portion inserted and fixed to the shaft fixing grooves, a rotary body surrounding the connection shaft and rotatably supported by the connection shaft, and a seat board fixing wing extending from the rotary body sideward and to which the seat board is fixed.

In addition, in the rotary bracket of the folding chair having a friction damping part according to the present invention, the connection shaft may be supported to be movable along a longitudinal direction in the rotary body such that the front end portion of the connection shaft may protrude from one end of the rotary body, and a connection shaft pressure spring elastically pressing the connection shaft in a direction in which the front end portion of the connection shaft protrudes from one end of the rotary body inside the rotary body such that the front end portion of the connection shaft protrudes by the elastic force when recessed by an external force and the external force is removed may be further included.

In addition, in the a folding chair having a friction damping part according to the present invention, the damping part may further include a damping housing which is inserted and fixed inside the rotary body while having a first shaft through-hole formed at the center of a front surface thereof such that a rear end portion of the connection shaft may be inserted thereinto in accordance with a longitudinal motion of the connection shaft, and supporting a rear end portion of the connection shaft pressure spring at a neighboring portion of the first shaft through-hole, a second shaft through-hole and a third shaft through-hole corresponding to the first shaft through-hole of the damping housing may be respectively formed at the friction clutch and the clutch pressure plate, the elastic pressure body may be formed of a hollow spiral spring into which the rear end portion of the connection shaft may be inserted, and the friction clutch, the clutch pressure plate, and the spiral spring may be sequentially disposed in the damping housing.

In addition, in the folding chair having a friction damping part according to the present invention, the clutch pressure plate may be connected to the damping housing through a key seat and have the rotation thereof restrained in relation to the damping housing to integrally rotate with the seat board, and the friction clutch may be formed to freely rotate in relation to the damping housing while the rotation thereof is restrained in relation to the connection shaft.

In addition, in the folding chair having a friction damping part according to the present invention, the friction clutch may have the friction surface formed at both front and rear surfaces, and the damping part may further include a friction auxiliary plate disposed in front of the friction clutch in the damping housing and formed corresponding to the clutch pressure plate such that the friction clutch is interposed between the clutch pressure plate and the friction auxiliary plate, wherein a fourth shaft through-hole corresponding to the first shaft through-hole of the damping housing may be formed at the friction auxiliary plate, and the friction auxiliary plate may be connected to the damping housing through a key seat and have the rotation restrained in relation to the damping housing to integrally rotate with the seat board.

In addition, in the folding chair having a friction damping part according to the present invention, the shaft fixing grooves of the fixed housings may have inclined taper surfaces with a narrow inner portion and wide outer portion formed at front and rear surfaces thereof with respect to a flat cross-section such that the seat board may be installed at a slant in predetermined front and rear inclined angles with respect to the stand frames.

In addition, in the folding chair having a friction damping part according to the present invention, the rotary bracket may further include a stopper protrusion protruding from the seat board fixing wing in a direction parallel to the front end portion of the connection shaft, and each of the fixed housings may further include a rotation guide groove recessed along a moving trajectory of the stopper protrusion in accordance with the rotation of the seat board, and a rotation restraining step formed in a shape to which the stopper protrusion may be locked at a predetermined position on the rotation guide groove such that the seat board may rotate in a range between a horizontal state and an upright state.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Hereinafter, a folding chair having a friction damping part according to the present invention will be described in more detail with reference to embodiments shown in the accompanying drawings.

Figure 1:
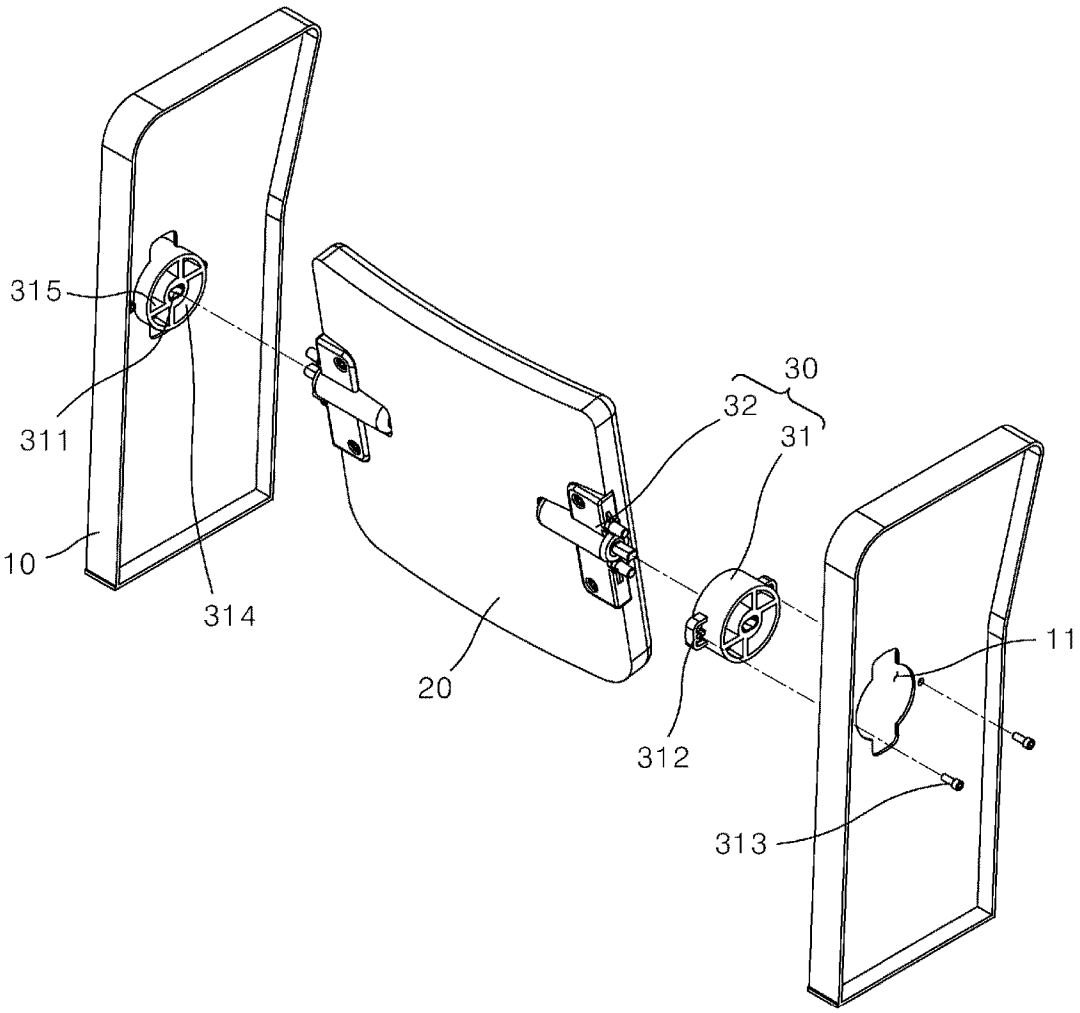
FIG. 1 is an exploded perspective view of a folding chair having a friction damping part according to an embodiment of the present invention.
Figure 2:
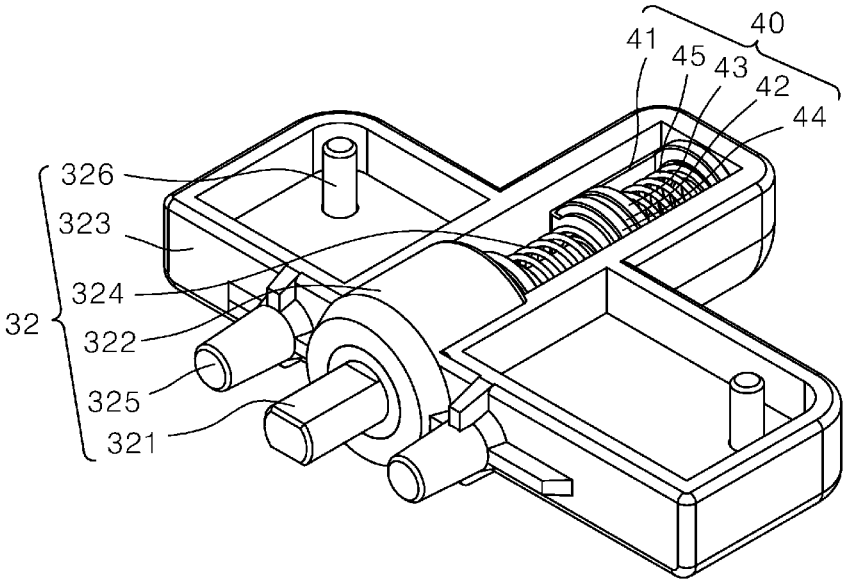
FIG. 2 is a perspective view of a main part of the folding chair having a friction damping part according to an embodiment of the present invention.
Figure 3:
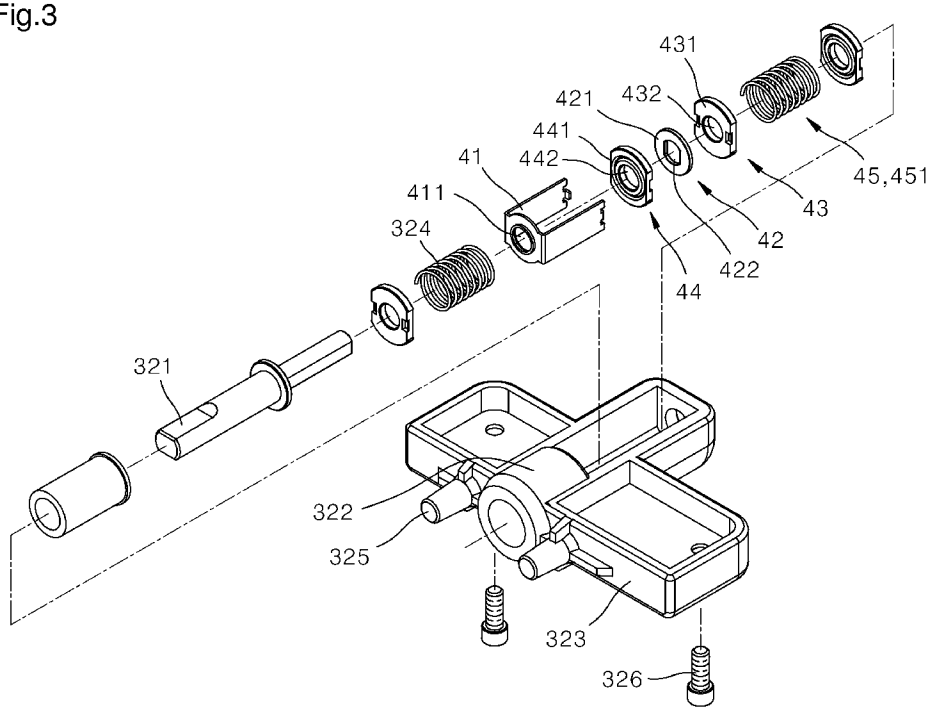
FIG. 3 is an exploded perspective view of the main part of the folding chair having a friction damping part according to an embodiment of the present invention.
Figure 4:
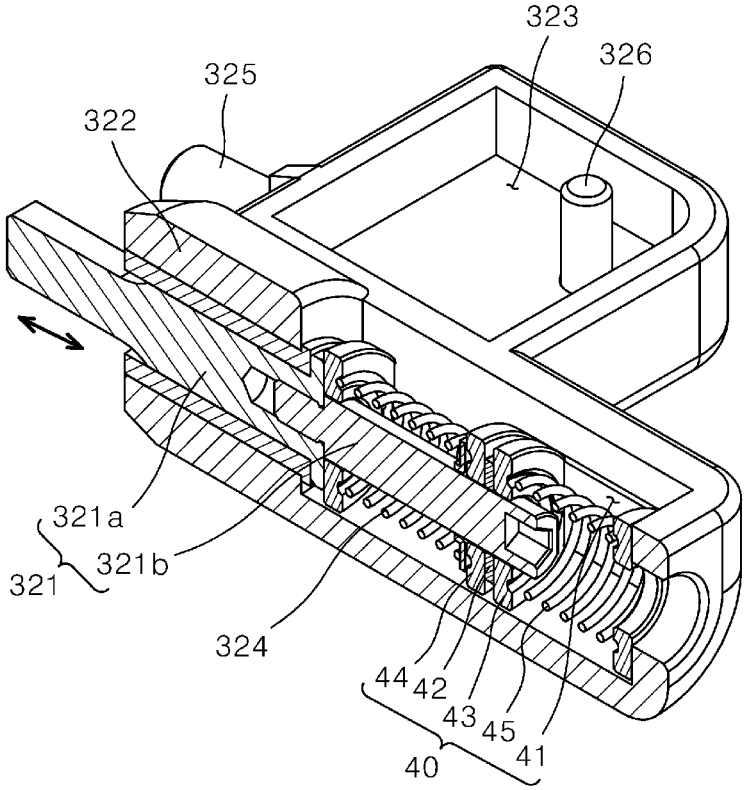
FIG. 4 is a perspective view of a cross section of the main part of the folding chair having a friction damping part according to an embodiment of the present invention.
Figure 5:
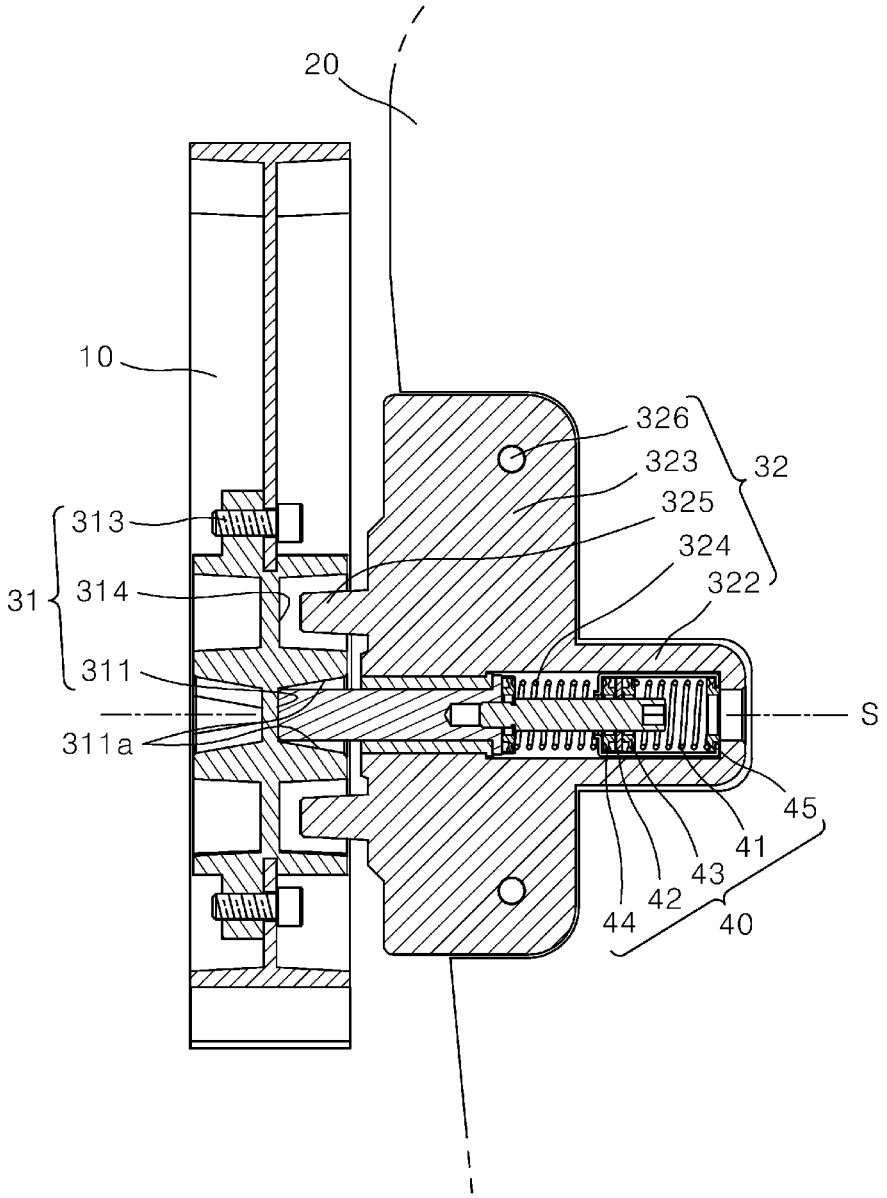
FIG. 5 is a flat cross-sectional view of the folding chair having a friction damping part according to an embodiment of the present invention.
Figure 6:
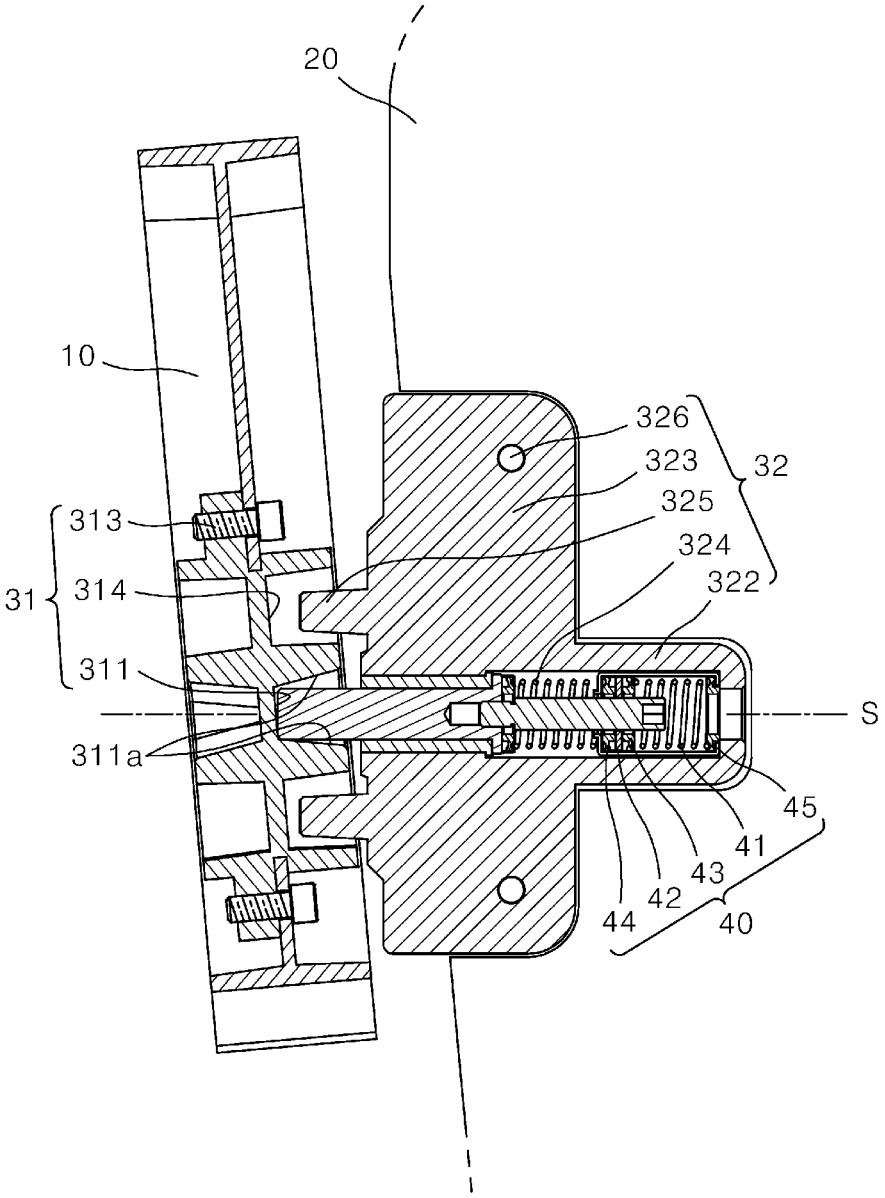
FIGS. 6 and 7 are flat cross-sectional views illustrating a curved installation state of the folding chair having a friction damping part according to an embodiment of the present invention.
Figure 7:
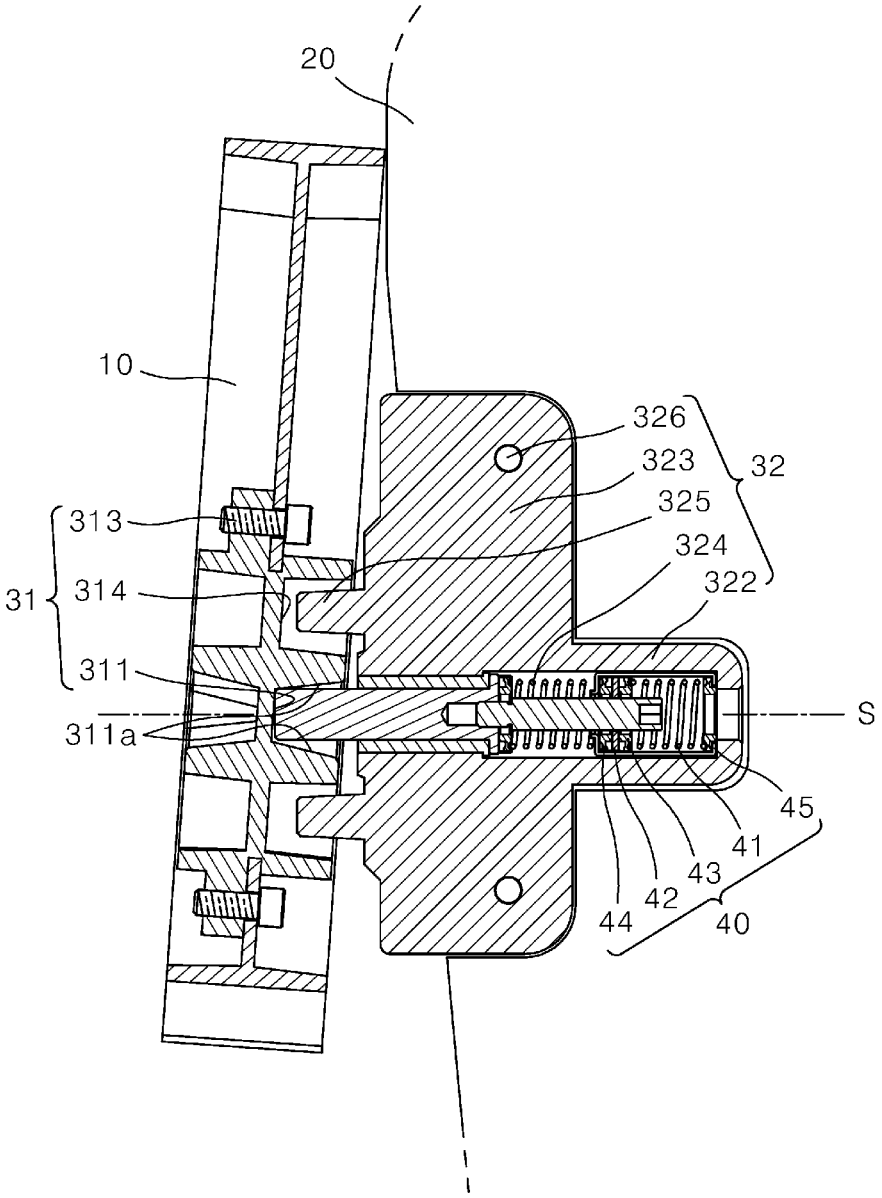

FIG. 1 is an exploded perspective view of a folding chair having a friction damping part according to an embodiment of the present invention, FIG. 2 is a perspective view of a main part, FIG. 3 is an exploded perspective view of the main part, FIG. 4 is a perspective view of a cross section of the main part, FIG. 5 is a flat cross-sectional view, and FIGS. 6 and 7 are flat cross-sectional views illustrating a curved installation state.

Referring to FIGS. 1 to 5, a folding chair having a friction damping part according to the present invention includes stand frames 10, a seat board 20, a rotary connection part 30, and a damping part 40.

A pair of stand frames 10 are stood upright on a floor, and the seat board 20 is disposed and supported therebetween.

The pair of stand frames 10 is preferably stood on the floor to maintain an interval of approximately 550 mm, and housing insertion holes 11 to have fixed housings 31 of the rotary connection part 30 inserted and installed thereinto may respectively penetrate and formed at the pair of stand frames 10 at a predetermined height from the floor.

The seat board 20 is a configuration for enabling a user to sit thereon, and is connected to the stand frames 10 by the rotary connection part 30 while being disposed between the pair of stand frames 10.

Although not shown in the drawings, a backrest (not shown) which supports a user's back may be installed behind the stand frames 10.

The rotary connection part 30 is a configuration which connects the seat board 20 to the pair of stand frames 10 to be vertically rotatable while having a rotary shaft line S as a center of rotation, and includes the fixed housings 31 and a rotary bracket 32 in an embodiment of the present invention.

Meanwhile, the rotary shaft line S is preferably disposed approximately 50 mm behind the center of the seat board 20, and may include a separate spring (not shown) or a balance weight (not shown) to normally maintain an upright state of the seat board 20.

The fixed housings 31 are configurations which are respectively inserted and fixed into the housing insertion holes 11 of the pair of stand frames 10, and each of the fixed housings 31 includes a shaft fixing groove 311, fixing flanges 312, fixing bolts 313, a rotation guide groove 314, and a rotation restraining step 315.

The shaft fixing groove 311 is a configuration which is formed at the center to have a front end portion of a connection shaft 321 of the rotary bracket 32 inserted and fixed thereto, and is formed in a rectangular shape to correspond to a cross-sectional shape of the front end portion of the connection shaft 321 in an embodiment of the present invention.

Meanwhile, inclined taper surfaces 311*a* with a narrow inner portion and a wide outer portion are respectively formed at front and rear surfaces of the shaft fixing groove 311 with respect to a flat cross section. Due to the configuration of the inclined taper surfaces 311*a*, the seat board 20 may be installed at a slant in predetermined front and rear inclined angles with respect to the stand frames 10 as shown in FIGS. 6 and 7, such that the folding chair according to the present invention may be installed at a circular stadium and also installed in a free curve.

The fixing flanges 312 are configurations which respectively protrude from a cylindrical body of each of the fixed housings 31 toward both left and right directions of an outside to prevent each of the fixed housings 31 from being detached from each of the housing insertion holes 11 when each of the fixed housings 31 rotates by 90° while being inserted into each of the housing insertion holes 11 of the stand frames 10 as shown in FIG. 1.

The fixing bolts 313 are configurations which are fastened between the fixing flanges 312 and the stand frames 10 to enable the fixed housings 31 to be fixed to the stand frames 10.

The rotation guide groove 314 is a configuration recessed at each of the fixed housings 31 along a moving trajectory of a stopper protrusion 325 of the rotary bracket 32 to be described below in accordance with rotation of the seat board 20.

The rotation restraining step 315 is a configuration formed in a shape to which the stopper protrusion 325 may be locked at a predetermined position on the rotation guide groove 314. The seat board 20 may rotate in a range between a horizontal state and an upright state by an organic coupling relation of the stopper protrusion 325, the rotation guide groove 314, and the rotation restraining step 315.

The rotary bracket 32 is a configuration which is connected to the fixed housings 31 while being fixed to the seat board 20, and includes the connection shaft 321, a rotary body 322, a seat board fixing wing 323, a connection shaft pressure spring 324, and the stopper protrusion 325.

The connection shaft 321 is a configuration having a front end portion inserted and fixed to the shaft fixing grooves 311 and rotatably supporting the rotary body 322. Thereby, the connection shaft 321 coincides with the rotary shaft line S.

Meanwhile, even though the connection shaft 321 is configured by connecting two different shafts 321*a* and 321*b* to each other to facilitate manufacturing thereof in an embodiment of the present invention, the connection shaft 321 may also be configured by one integrated shaft.

In addition, the connection shaft 321 is movably supported along the longitudinal direction in the rotary body 322 such that the front end portion of the connection shaft 321 may protrude from one end of the rotary body 322.

In other words, as the front end portion of the connection shaft 321 is protrudably configured, the front end portion of the connection shaft 321 may be inserted into the shaft fixing grooves 311 of the fixed housings 31 even when the pair of stand frames 10 is stood upright in a predetermined interval.

The rotary body 322 is a configuration which is rotatably supported by the connection shaft 321 while surrounding the connection shaft 321. The seat board 20 vertically rotates as a result in accordance with rotation of the rotary body 322.

The seat board fixing wing 323 is a configuration which extends sideward from the rotary body 322 to be fixed by a seat board fixing protrusion 326 while the seat board 20 is seated on the seat board fixing wing 323.

The connection shaft pressure spring 324 is a configuration which elastically presses the connection shaft 321 in the rotary body 322 in a direction in which the front end portion of the connection shaft 321 protrudes from one end of the rotary body 322.

The front end portion of the connection shaft 321 protrudes by the elastic force when is recessed by an external force and the external force is removed by the configuration of the connection shaft pressure spring 34, such that the front end portion of the connection shaft 321 is easily inserted and fixed to the shaft fixing grooves 311 of the fixed housings 31.

The stopper protrusion 325 is a configuration which protrudes from the seat board fixing wing 323 in a direction parallel to the front end portion of the connection shaft 321. As stated above, the seat board 20 is able to rotate in a range between the horizontal state and upright state by the organic coupling relation of the stopper protrusion 325, the rotation guide groove 314, and the rotation restraining step 315.

The damping part 40 is a configuration capable of decelerating a rotary speed of the seat board 20, and includes a damping housing 41, a friction clutch 42, a clutch pressure plate 43, a friction auxiliary plate 44, and an elastic pressure body 45 in an embodiment of the present invention.

The damping housing 41 is a configuration which is inserted and fixed to an inner portion of the rotary body 322, while having a first shaft through-hole 411 formed at the center of a front surface thereof to enable a rear end portion of the connection shaft 321 to be inserted thereinto in accordance with a longitudinal motion of the connection shaft 321, and supporting a rear end portion of the connection shaft pressure spring 324 at a neighboring portion of the first shaft through-hole 411, and the friction auxiliary plate 44, the friction clutch 42, the clutch pressure plate 43, and the elastic pressure body 45 are sequentially disposed inside the damping housing 41.

The friction clutch 42 is a configuration which is disposed on the rotary shaft line S while having a friction surface 421 arranged in a direction perpendicular to the rotary shaft line S.

In an embodiment of the present invention, the friction clutch 42 is interposed between the friction auxiliary plate 44 and the clutch pressure plate 43, thereby having the friction surface 421 formed at both front and rear surfaces thereof.

In addition, a second shaft through-hole 422 corresponding to the first shaft through-hole 411 of the damping housing 41 is formed at the friction clutch 42, such that the rear end portion of the connection shaft 321 may be inserted thereinto in accordance with the longitudinal motion of the connection shaft 321.

In addition, rotation of the friction clutch 42 is restrained in relation to the connection shaft 321 while the friction clutch 42 may freely rotate in relation to the damping housing 41 such that a mutual friction force may be generated between the clutch pressure plate 43 and the friction auxiliary plate 44 which integrally rotate with the damping housing 41.

The clutch pressure plate 43 is a configuration having a pressure surface 431 coming in contact with the friction surface 421 of the friction clutch 42, and a third shaft through-hole 432 corresponding to the first shaft through-hole 411 of the damping housing 41 is formed at the clutch pressure plate 43 such that the rear end portion of the connection shaft 321 may be inserted thereinto in accordance with the longitudinal motion of the connection shaft 321.

In addition, the clutch pressure plate 43 is connected to the damping housing 41 through a key seat 433 to have rotation thereof restrained in relation to the damping housing 41 to integrally rotate with the seat board 20.

The friction auxiliary plate 44 is a configuration which is disposed in front of the friction clutch 42 in the damping housing 41 to correspond to the clutch pressure plate 43 such that the friction clutch 42 is interposed between the clutch pressure plate 43 and the friction auxiliary plate 44.

A fourth shaft through-hole 441 corresponding to the first shaft through-hole 411 of the damping housing 41 is formed at the friction auxiliary plate 44 to enable the rear end portion of the connection shaft 321 to be inserted thereinto in accordance with the longitudinal motion of the connection shaft 321, and like the clutch pressure plate 43, the friction auxiliary plate 44 is connected to the damping housing 41 through a key seat 442 to have rotation thereof restrained in relation to the damping housing 41 to integrally rotate with the seat board 20.

The elastic pressure body 45 is a configuration which elastically presses the clutch pressure plate 43 toward the friction clutch 42 such that a friction force may be generated between the friction auxiliary plate 44 and the clutch pressure plate 43, and the friction clutch 42.

In an embodiment of the present invention, the elastic pressure body 45 is formed of a hollow spiral spring 451 into which the rear end portion of the connection shaft 321 may be inserted.

By the above configuration, the folding chair having a friction damping part according to the present invention is able to decelerate a rotary speed of the seat board 20, thereby reducing noise generation and decreasing a possibility of being damaged due to rapid rotation of the seat board 20, and is able to configure the damping part 40 using a mechanical friction force and elastic force such as the friction clutch 42, the clutch pressure plate 43, and the elastic pressure body 45, thereby having a simple structure, being easily manufactured, not malfunctioning frequently, and guaranteeing a sufficient damping force for a long period.

By the above configuration, a folding chair having a friction damping part according to the present invention has a damping part, thereby reducing noise generation and decreasing a possibility of being damaged due to rapid rotation of a seat board, and decreasing a possibility of accidents caused by the rapidly rotating seat board.

In addition, the folding chair having a friction damping part according to the present invention configures a damping part having a mechanical mechanism using a friction force and elastic force such as a friction clutch, a clutch pressure plate, and an elastic pressure body, thereby having a simple structure, being easily manufactured, not malfunctioning frequently, and guaranteeing a sufficient damping force for a long period.

In addition, the folding chair having a friction damping part according to the present invention is capable of having a seat board installed at a slant in predetermined front and rear inclined angles with respect to stand frames, thereby being able to be installed at a circular stadium and also installed in a free curve.

The folding chair having a friction damping part which has been described above and shown in the drawings is merely one embodiment for practicing the present invention, and should not be construed as limiting the technical spirit of the present invention. The scope of the present invention should be defined only by those mentioned in the patent claims below, and embodiments improved and modified without departing from the gist of the present invention should be construed as belonging to the scope of the present invention as long as the embodiments are obvious to those of ordinary skill in the art to which the present invention pertains.

What is claimed is:

1. A folding chair having a friction damping part, the folding chair comprising:

a pair of stand frames configured to be supported on a floor;

a seat board disposed between the pair of stand frames in a shape on which a user may be seated;

a rotary connection part configured to connect the seat board to the pair of stand frames to be vertically rotatable while having a rotary shaft line as a center of rotation; and a damping part capable of decelerating a rotary speed of the seat board, wherein the damping part comprises a friction clutch disposed on the rotary shaft line and having a friction surface arranged in a direction perpendicular to the rotary shaft line, a clutch pressure plate configured to integrally rotate with the seat board and having a pressure surface configured to come in contact with the friction surface of the friction clutch, and an elastic pressure body configured to elastically press the clutch pressure plate toward the friction clutch.

2. The folding chair according to claim 1, wherein:

the rotary connection part comprises fixed housings respectively fixed to the pair of stand frames, and a rotary bracket connected to the fixed housings while being fixed to the seat board;

a shaft fixing groove is formed at the center of each of the fixed housings; and the rotary bracket comprises a connection shaft having a front end portion inserted and fixed to the shaft fixing groove, a rotary body configured to surround the connection shaft and be rotatably supported by the connection shaft, and a seat board fixing wing configured to extend sideward from the rotary body and to which the seat board is fixed.

3. The folding chair according to claim 2, wherein:

in the rotary bracket, the connection shaft is supported to be movable along a longitudinal direction in the rotary body such that the front end portion of the connection shaft can protrude from one end of the rotary body; and the rotary bracket further comprises a connection shaft pressure spring configured to elastically press the connection shaft in a direction in which the front end portion of the connection shaft protrudes from one end of the rotary body inside the rotary body such that the front end portion of the connection shaft protrudes by an elastic force of the connection shaft pressure spring when recessed by an external force and the external force is removed.

4. The folding chair according to claim 3, wherein the shaft fixing grooves of the fixed housings have inclined taper surfaces with a narrow inner portion and a wide outer portion formed at front and rear surfaces thereof with respect to a flat cross-section, such that the seat board may be installed at a slant in predetermined front and rear inclined angles with respect to the stand frames.

5. The folding chair according to claim 3, wherein:

the damping part further comprises a damping housing inserted and fixed inside the rotary body while having a first shaft through-hole formed at the center of a front surface thereof such that a rear end portion of the connection shaft may be inserted thereinto in accordance with a longitudinal motion of the connection shaft, and being configured to support a rear end portion of the connection shaft pressure spring at a neighboring portion of the first shaft through-hole;

a second shaft through-hole and a third shaft through-hole corresponding to the first shaft through-hole of the damping housing are respectively formed at the friction clutch and the clutch pressure plate;

the elastic pressure body is formed of a hollow spiral spring into which the rear end portion of the connection shaft may be inserted; and the friction clutch, the clutch pressure plate, and the spiral spring are sequentially disposed in the damping housing.

6. The folding chair according to claim 5, wherein the shaft fixing grooves of the fixed housings have inclined taper surfaces with a narrow inner portion and a wide outer portion formed at front and rear surfaces thereof with respect to a flat cross-section, such that the seat board may be installed at a slant in predetermined front and rear inclined angles with respect to the stand frames.

7. The folding chair according to claim 5, wherein:

the clutch pressure plate is connected to the damping housing through a key seat and the rotation thereof is restrained in relation to the damping housing to integrally rotate with the seat board; and the friction clutch is formed to freely rotate in relation to the damping housing while the rotation thereof is restrained in relation to the connection shaft.

8. The folding chair according to claim 7, wherein the shaft fixing grooves of the fixed housings have inclined taper surfaces with a narrow inner portion and a wide outer portion formed at front and rear surfaces thereof with respect to a flat cross-section, such that the seat board may be installed at a slant in predetermined front and rear inclined angles with respect to the stand frames.

9. The folding chair according to claim 7, wherein:

the friction clutch has the friction surface formed at both front and rear surfaces thereof;

the damping part further comprises a friction auxiliary plate disposed in front of the friction clutch in the damping housing and formed corresponding to the clutch pressure plate such that the friction clutch is interposed between the clutch pressure plate and the friction auxiliary plate;

a fourth shaft through-hole corresponding to the first shaft through-hole of the damping housing is formed at the friction auxiliary plate; and the friction auxiliary plate is connected to the damping housing through a key seat and has the rotation thereof restrained in relation to the damping housing to integrally rotate with the seat board.

10. The folding chair according to claim 9, wherein the shaft fixing grooves of the fixed housings have inclined taper surfaces with a narrow inner portion and a wide outer portion formed at front and rear surfaces thereof with respect to a flat cross-section, such that the seat board may be installed at a slant in predetermined front and rear inclined angles with respect to the stand frames.

11. The folding chair according to claim 2, wherein the shaft fixing grooves of the fixed housings have inclined taper surfaces with a narrow inner portion and a wide outer portion formed at front and rear surfaces thereof with respect to a flat cross-section, such that the seat board may be installed at a slant in predetermined front and rear inclined angles with respect to the stand frames.

12. The folding chair according to claim 11, wherein:

the rotary bracket further comprises a stopper protrusion configured to protrude from the seat board fixing wing in a direction parallel to the front end portion of the connection shaft; and each of the fixed housings further comprises a rotation guide groove recessed along a moving trajectory of the stopper protrusion in accordance with the rotation of the seat board, and a rotation restraining step formed in a shape to which the stopper protrusion may be locked at a predetermined position on the rotation guide groove such that the seat board may rotate in a range between a horizontal state and an upright state.

* * * * *